US006015113A

United States Patent [19]

Daly et al.

[11] Patent Number: 6,015,113

[45] Date of Patent: Jan. 18, 2000

[54] WINDER FOR SYNTHETIC FILAMENTS

[75] Inventors: Thomas Patrick Daly, Aston, Pa.; Joseph Edward Koskol, Newark, Del.; Kevin Robert Madigan, Charlottesville, Va.; Jun Takagi; Naofumi Yamauchi, both of Shiga, Japan

[73] Assignee: E. I. du Pont de Nemours and Company, Wilmington, Del.

[21] Appl. No.: 09/166,309

[22] Filed: Oct. 5, 1998

Related U.S. Application Data

[63] Continuation-in-part of application No. 08/944,217, Oct. 6, 1997, abandoned.

[51] Int. Cl.[7] ..... B65H 67/044; B65H 54/02; B65H 57/00

[52] U.S. Cl. ..... 242/474.5; 242/157 R; 242/473.9; 242/475.7; 242/920

[58] Field of Search ..... 242/473.9, 474.5, 242/474.6, 475.7, 157 R, 920, FOR 134

[56] References Cited

U.S. PATENT DOCUMENTS

| | | | |
|---|---|---|---|
| 3,165,274 | 1/1965 | De Priest | 242/474.6 |
| 3,342,428 | 9/1967 | Smiley, Jr. | 242/474.6 |
| 3,544,017 | 12/1970 | Schippers | 242/157 R X |
| 3,924,817 | 12/1975 | Symborski | 242/920 X |
| 4,013,833 | 3/1977 | Hasegawa et al. | 242/474.5 |
| 4,052,016 | 10/1977 | Cunningham et al. | 242/474.5 |
| 4,389,024 | 6/1983 | Sanders | 242/157 R X |
| 4,693,429 | 9/1987 | Billard et al. | 242/474.5 |
| 4,969,607 | 11/1990 | Busenhart et al. | 242/474.5 |
| 5,029,762 | 7/1991 | Behrens et al. | 242/473.5 |
| 5,156,347 | 10/1992 | Gay, II et al. | 242/474.5 |
| 5,219,125 | 6/1993 | Rigg | 242/474.5 |
| 5,308,004 | 5/1994 | Ukai et al. | 242/474.6 |
| 5,407,143 | 4/1995 | Nakai et al. | 242/474.5 |
| 5,489,067 | 2/1996 | Nakai et al. | 242/474.5 |
| 5,526,995 | 6/1996 | Westrich et al. . | |
| 5,566,904 | 10/1996 | Hashimoto . | |

*Primary Examiner*—Michael R. Mansen
*Attorney, Agent, or Firm*—George A. Frank

[57] ABSTRACT

A compact multi-position spindle-and-turret winder for winding synthetic continuous fibers having a first winding position and one-four subsequent indexed winding positions and a method for winding continuous filaments are provided.

18 Claims, 11 Drawing Sheets

WINDER FOR SYNTHETIC FILAMENTS

CROSS-REFERENCE TO RELATED APPLICATIONS

This application is a continuation-in-part of application Ser. No. 08/944,217, filed Oct. 6, 1997, now abandoned.

FIELD OF THE INVENTION

This invention relates to a winder for winding synthetic continuous filaments onto a core to form a wound package. More particularly, the invention relates to a compact multi-position spindle-and-turret winder for winding continuous non-elastomeric and elastomeric fibers.

BACKGROUND ART

In making continuous filaments, the fibers are generally collected by winding them up on a bobbin or cylindrical core (a "tubecore") to form a wound package. For making spandex, surface-driven winders such as described in U.S. Pat. Nos. 3,165,274 and 3,342,428 have generally been used.

U.S. Pat. No. 5,219,125 discloses a two-position spindle-and-turret winder having a traverse mechanism and rotatable bail roller mounted on an arm. However, the system disclosed has a only a single winding position and therefore must be made excessively bulky when large packages are to be wound. Further, because the traverse arm is mounted horizontally and above the spindles, in the event of a power failure, the dead weight of the traverse arm could seriously damage the spindles.

U.S. Pat. No. 5,489,067 discloses a spindle-and-turret winder having a substantially fixed contact roll and traverse guide in which a very low elongation fiber is fed directly to the nip between the contact roll and package while the turret rotates continuously to accommodate the growing package. The continuous movement of the turret during the winding requires a complex mechanism and controls for successful winding. Further, such continuous movement causes a full package not to be in a fixed position, which can make it difficult to doff, especially by automated means.

U.S. Pat. Nos. 5,526,995 and 5,029,762 disclose a winder having a contact roll whose position remains substantially unchanged during winding and a turret that rotates substantially continuously during the building of the package. The continually rotating turret requires complex controls for winding filaments. As with U.S. Pat. No. 5,219,125, the weight of the traverse arm could seriously damage the spindles in the event of a power failure.

U.S. Pat. No. 5,566,904 discloses a winder for elastomeric fibers which has a single winding position and requires a lifting box, which makes this winder undesirably tall. In addition, the movable arm must be cantilevered, so it is insufficiently rigid and therefore the life of the pivot is unsatisfactorily short.

The present invention provides a compact winder for continuous synthetic fibers.

SUMMARY OF THE INVENTION

The winder of the present invention for winding synthetic continuous elastomeric filament comprises:

(a) a frame having a front face;

(b) a support mounted on the face and perpendicular to the face;

(c) a driven turret having an axis and being rotatably mounted on the face;

(d) a first driven spindle assembly having an axis and a second driven spindle assembly, the spindle assemblies being rotatably mounted on the turret on opposite sides of the turret axis and being capable of having tubecores mounted thereon;

(e) a freely rotatable contact roll having an axis and being mounted substantially parallel to the first and second spindle assemblies and below a horizontal plane in which the turret axis lies; and (f) a traverse assembly comprising a traverse cam mounted axially parallel and adjacent to the contact roll so that filament passing the traverse assembly is capable of traversing back and forth along the contact roll, the traverse assembly and contact roll being mounted on a pendulous swing arm pivotably mounted on the support and capable of pivoting through at least about 7°; wherein the turret, first and second spindle assemblies, swing arm, traverse assembly, and contact roll are mounted in order that (i) rotation of the turret to a first indexed winding position is capable of urging a tubecore mounted on the first spindle assembly against the contact roll for partial winding of a package;

(ii) during rapid rotation of the turret to and between 1–4 subsequent indexed winding positions, the partially wound package on the first spindle assembly can remain in contact with the contact roll;

(iii) rotation of the turret to a final position is capable of presenting the package on the first spindle assembly for doffing and is capable of urging a tubecore on the second spindle assembly against the contact roll for first position winding;

(iv) a filament wrap angle around the contact roll is about 180°–225°; and (v) at least about 99% of the winding occurs at the least indexed positions.

The method of the present invention for winding synthetic continuous elastomeric filament comprises the steps of:

(a) passing the filament through a cam-driven traverse guide and around a contact roll with a wrap angle of about 180°–225°;

(b) winding the filament onto a first indexed tubecore at a first winding position to form a partially wound package;

(c) moving the partially wound package to and between 1–4 subsequent indexed winding positions;

(d) winding the filament onto the partially wound package at each subsequent indexed winding position to form a fully wound package, at least about 99% of the winding occurring at the indexed positions;

(e) moving the fully wound package to a final position for doffing and simultaneously moving a second tubecore to the first winding position;

(f) transferring the filament from the fully wound package to the second tubecore; and (g) winding the filament onto the second tubecore.

The present invention for winding non-elastomeric fibers, and the winders themselves, differ from the winder and method described hereinabove by using grooved tubecores, having a filament wrap around the contact roll of about 165°–220°, and the swing arm being capable of pivoting through at least about 5°.

DETAILED DESCRIPTION OF THE INVENTION

Figure 1:
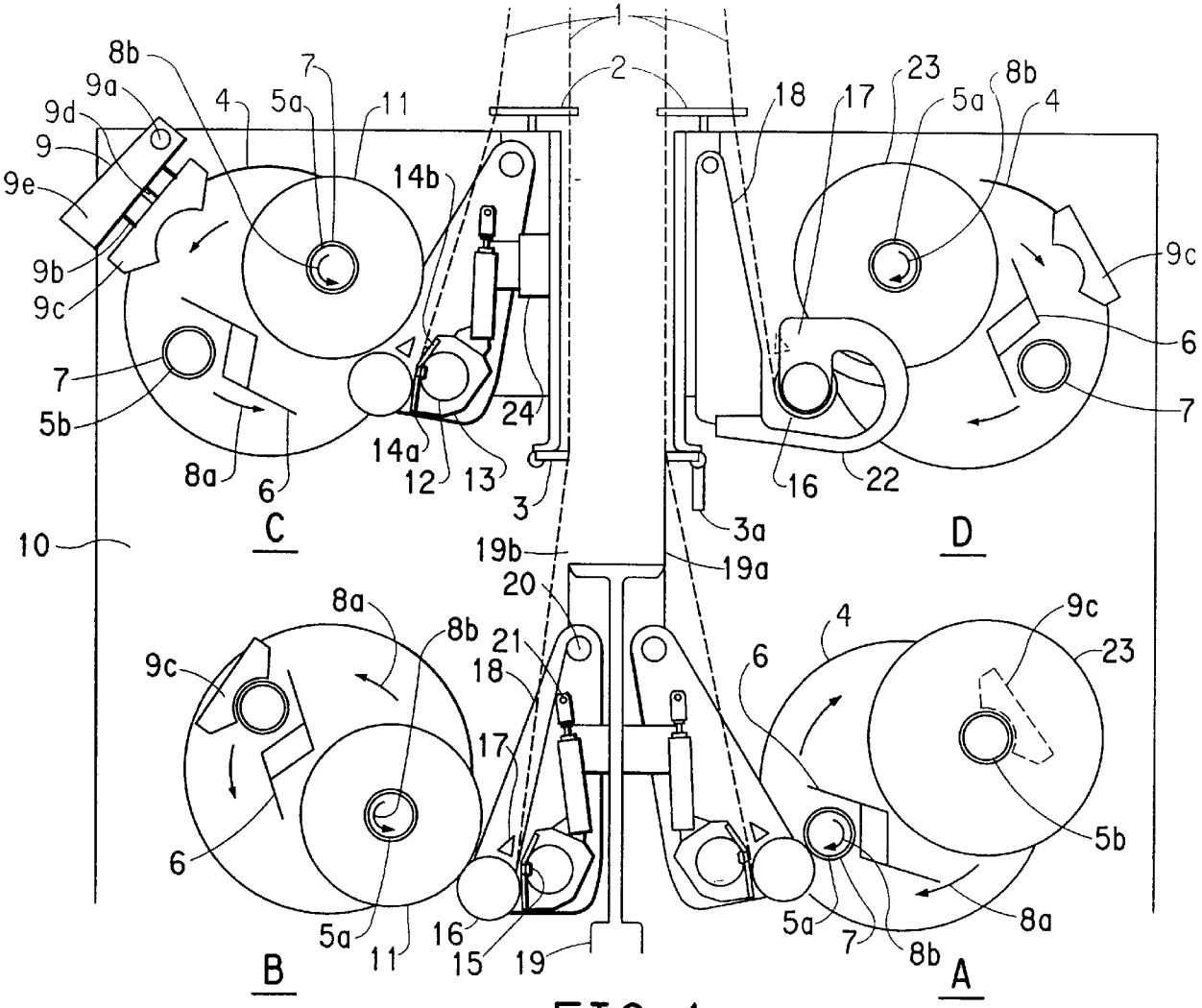
FIG. 1 shows winders of the present invention from the front; four winders A, B, C, and D are shown grouped together, each illustrating a phase of winding of elastomeric fibers.

Continuous filament can be wound up after spinning by passing it through a traverse guide reciprocated by a traverse cam, over a contact roll and, at the start of winding a new package, onto a rotating tubecore. As the package grows, the fiber is wound onto underlying, previously wound filament. The angle measured from where the fiber arrives at a roll to where the fiber leaves a roll (for example the contact roll) is called the "wrap angle"; thus, a reversal of direction at the contact roll would be a wrap angle of 180°. A "break angle" is the angular change of direction which the fiber makes as it passes a guide or other surface having a small radius of curvature. "Roll wraps" are undesirable entanglements of the yarn with a roll (especially the contact roll) which can result from tacky fibers such as spandex sticking to the contact roll instead of leaving it at the proper point. A high "break angle" is undesirable because it causes high tension in the fiber with consequent degradation in package quality. "Filament", "fiber", "yarn", and "threadline", as used herein, have the same meaning. "Axis" means longitudinal axis.

The winder of the present invention can be used to wind continuous non-elastomeric filaments or continuous elastomeric filaments, including spandex, and has a first indexed winding position and one-four, preferably one-three, subsequent indexed winding positions. When a small package is to be wound, only the first position need be used, and any subsequent indexed positions are unused during the don/wind/doff sequence. For larger packages of elastomeric filaments, the winder preferably has three positions, two for winding and one for donning/doffing. For non-elastomeric filaments, the winder preferably has four positions, three for winding and one for donning/doffing.

By "elastomeric" filaments is meant filaments (for example spandex and polyetheresters) which have a break elongation in excess of 100% and which when stretched and released, retract quickly and forcibly to substantially their original length. "Non-elastomeric" filaments have lower elongation-to-break and do not recover rapidly or forcibly after being so stretched. Examples of non-elastomeric filaments include filaments made from poly(ethylene terephthalate), polycaprolactam, and poly(hexamethylene adipamide). "Spandex" is a manufactured fiber in which the fiber-forming substance is a long chain synthetic elastomer comprised of at least 85% by weight of a segmented polyurethane.

For sake of convenience, the invention will be described in terms of a three-position winder for spandex having two winding positions, that is, a first indexed winding position, a second winding position indexed subsequent to the first winding position, and a final, doffing position. However, a multi-position winder capable of winding at a first indexed winding position and more than one (2–4) subsequent winding position, all such positions being rotatably indexed apart, can also be utilized. "Indexed" means that the positions are individually distinct from one another and at discrete, well-defined intervals, so that the swept angle (as defined below) is at least about 10°. Rotation between the first and final positions is not continuous.

The present invention provides a compact three-position spindle-and-turret winder in which fiber is wound onto a growing package at two of the three positions. During winding at each indexed position, the turret is substantially fixed and does not rotate. Mounting the traverse assembly and contact roll on a swing arm which can pivot through at least about 7°, as in the present invention, permits considerable flexibility in adapting the positions of the traverse assembly and contact roll to the growing package. The geometry of the winder at the first position permits use of a small diameter tubecore and a short, compact swing arm which in spite of its small size can urge the contact roll against such a tubecore. The geometry of the second winding position permits the winder to be compact even when a large package is being wound, because even a large package can be kept close to the incoming filament threadline and to the center of a group of winders.

The use of two such winding positions permits the swing arm to pivot about the same amount for both positions and avoids undesirably large break angles at guides which direct the filament to the traverse assembly, regardless of package size.

Further, the turret need not be continuously rotated to accommodate the increasing diameter of the package; this permits doffing of full packages and donning of empty tubecores at a fixed position, since the turret is stationary during most of the winding.

As a result of these features, the winder of the present invention permits winding elastomeric and non-elastomeric fibers onto packages in a compact space, especially when several winders are grouped together.

Turning first to FIG. 1, a group of four winders of this invention is shown. This permits the most compact arrangement. The elastomeric filament threadline, for example spandex, is shown at 1. Four threadlines are illustrated, one for each winder. The spandex is guided by fanning guides 2 and 3, which can be self-stringing. Fanning guides 2 can each comprise two fanning guides, one above the other, for better control of threadline position. Fanning guides 3, which are preferably self-stringing, can have a knockout bar 3*a* mounted on a hinge attached to support 19. Closure of the knockout bar forces the filaments out of the guides, as will be described hereinafter. Four turrets 4 are illustrated, each mounted on frame 10 and rotatable in the direction shown by arrows 8*a*–8*c*.

When the winders are stacked as shown in FIG. 1, the two lower turrets can be mounted somewhat closer to the central axis of the frame in order for two of the threadlines 1 to be led readily to the lower winders for improved compactness. On each turret are rotatably mounted two spindle assemblies 5*a* and 5*b*. Each spindle assembly comprises a driven spindle and a chuck on which tubecores 7 can be mounted. "Driven" means that power can be provided, directly or indirectly, for example by an electric motor. Transfer shield 6, shown in cross-section, is slidably mounted on turret 4 between the spindle assemblies. Driven spindle assemblies

5*a* and 5*b* are positioned on approximately opposite sides of the axis of the turret and rotate substantially in the direction shown by arrows 8*b*. Thus, when winding elastomeric filaments, the spindle assemblies rotate in the same direction as the turrets on which they are mounted, that is, they are co-rotating. A brief exception to such co-rotation is described hereinafter for yarn transfer.

Push-off assembly 9 is mounted on pneumatic cylinder 9*a* (seen in cross-section), which is in turn mounted on frame 10. Push-off paddle 9*c* is attached to plate 9*e* by means of springs 9*b* and support rod 9*d*. The push-off assembly can be similar to that disclosed in Japanese Patent Application Publication No. 56-056774 (1981).

A partially wound spandex package is shown at 11. A traverse assembly comprises a cylindrical grooved traverse cam 12, which is rotatably mounted in cam box 13, on which are fixedly mounted rails 14*a* and 14*b*, between which is slidably mounted traverse guide 15. The traverse guide is mounted on a cam follower 15*a* (see FIG. 2), which is slidably mounted in a groove (not shown) of the traverse cam. The cam can be of any suitable design, including single, 2-, 3-, 4- or higher-cycle cams. The cam is driven by an electric motor.

Figure 5:
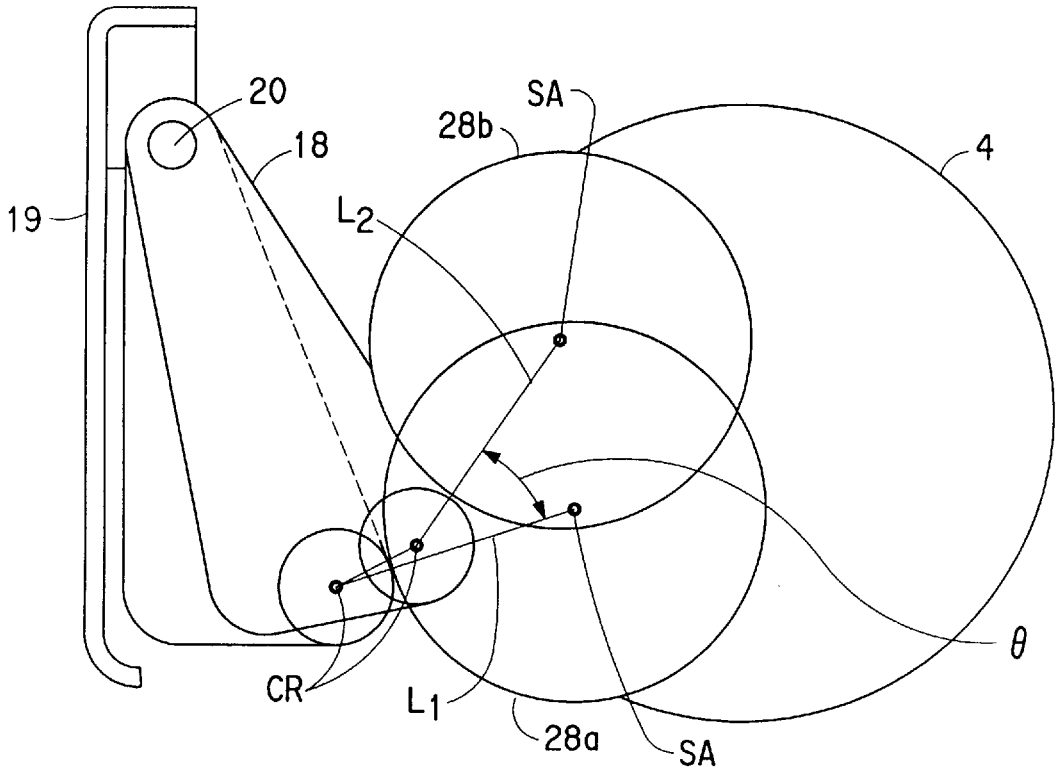
FIG. 5 shows details of the rotation of the turret from the first winding position to a second winding position.

Contact roll 16 is positioned between traverse cam 13 and the nearest (actively winding) spindle assembly 5*a*. As shown in FIGS. 1, 5, 6, 7, and 8, the axis of contact roll 16 is below a horizontal plane in which the axis of corresponding turret 4 lies. This contributes to the compactness of the winder. If the contact roll axis were above such horizontal plane, for example, if the winder were inverted, the winder would become excessively tall because upper fanning guides 2 would have to be raised substantially. This would also result in the break angles of the filament arriving from the spinning cell feed roll being too high for good package quality, and if the winder were kept short by mounting it on the floor, fully wound package 23 would be too close to the floor for easy doffing. The contact roll generally has a surface suitable for holding the fiber in substantially the same pattern as is traced out by the traverse guide during the time the yarn is on the contact roll while at the same time minimizing the tendency of the fiber to wrap completely around the roll. As shown in FIGS. 1 and 5, the wrap angle of the elastomeric fiber around the contact roll is about 180°–225°, increasing from the lower value to the higher value as winding progresses and the package increases in size. This high range of contact roll wrap angles permits the winder to be unusually compact while also allowing operator access to the contact roll for removal of any roll wraps. The contact roll is urged against the surface of the actively winding package of fiber by swing arm 18, which is urged toward the winding spindle assembly by pneumatic pancake cylinder 24, mounted on support 19. Suitable sensing and control systems can be provided to pressurize the pancake cylinders accurately so that the correct force is applied by the contact roll to the fiber package. The contact roll can be driven by an electric motor (not shown) or freely rotating, being turned by contact with the adjacent tubecore or wound package surface. Free rotation is preferred.

Wrap removal guide bar 17 is mounted adjacent to and parallel to the axis of contact roll 16. Its center axis can be hollow, so that it has a central void and a tubular wall. A plurality of holes through the wall can connect the central void with the region external to the guide bar. The holes are aligned so that each hole is directed toward the closer tubecore at the time of fiber transfer.

Swing arms 18 are mounted on support 19 at pivot point 20 so that they are pendulous, that is, they hang down. As shown in FIG. 1, the swing arms can pivot through at least 7° and preferably 10° to accommodate the increasing diameter of the wound filament package. At 19*a*, the support is shown as it is at the front of the winder and at the face of the frame; at 19*b*, it is seen that the area between the front and frame face is left open, since this area is swept by the traversing threadlines. For each winder apparatus there are two swing arms 18, one at the rear, near the frame face, as shown in FIG. 1, winders "A", "B", and "C", and one at the front of the winder as shown for winder "D". The pivoting of swing arm 18 can cause threadline movement, and use of a double fanning guide 2 can help to maintain threadline control. A pneumatic cylinder 21 is mounted on each swing arm. Cam box 13 is fixedly mounted on and between each pair of swing arms. The end of guide bar 17 and the end of contact roll 16 which are closest to the frame face are fixedly mounted and rotatably mounted, respectively, on the rear (frame face) member of each pair of swing arms. Bearing support rail 22 is fixedly mounted on the front swing arm and supports the front end of rotatable contact roll 16 and the front end of fixed guide bar 17. The shape of rail 22 gives an operator access to the circumference of roll 16, the nip between roll 16 and empty tubecore 7, and the circumference of tubecore 7 during stringup. The rail also collects and holds any contact roll wraps which have been removed from the contact roll by the operator.

A plurality of threadlines can be wound by each spindle assembly, depending on the length of the spindle assembly, contact roll, and cam, and on the number of tube cores mounted on each spindle assembly. Matte finish and mirror finish areas on the contact roll and the selected pattern of traverse cam grooves are repeated along the length of the roll and cam, respectively, to suit the number of tubecores used and threadlines wound.

The winder can be used singly, doubly, or in higher multiples. Groups of at least two winders are preferred. For example, a pair of such winders can be arranged in a side-by-side relationship (for example A and B of FIG. 1) for a narrow space or a vertical relationship (for example B and C of FIG. 1) for a short vertical space. In the vertical relationship, the lower winder is preferably offset from the upper winder so that the threadlines to the lower winder can pass the upper winder without interference.

In FIG. 1, four winders A, B, C, and D, with turrets, swing arms, and other associated parts are shown. With such a preferred arrangement, multiples of 4 threadlines can be wound, for example 4, 12, 16, 24, 32, 64, 128, and so on, depending on the number of tubecores 7 mounted on each spindle assembly 5. Except for the positions of swing arms 18 and the amount of fiber wound on the packages, winders A and D are mirror images of winders B and C, and the directions of rotation of contact roll 16, spindle assemblies 5, and turret 4 are correspondingly reversed. Each of the various parts described for the winder is present at each of winders A, B, C, and D but is not illustrated at each winder, for greater simplicity.

Figure 2:
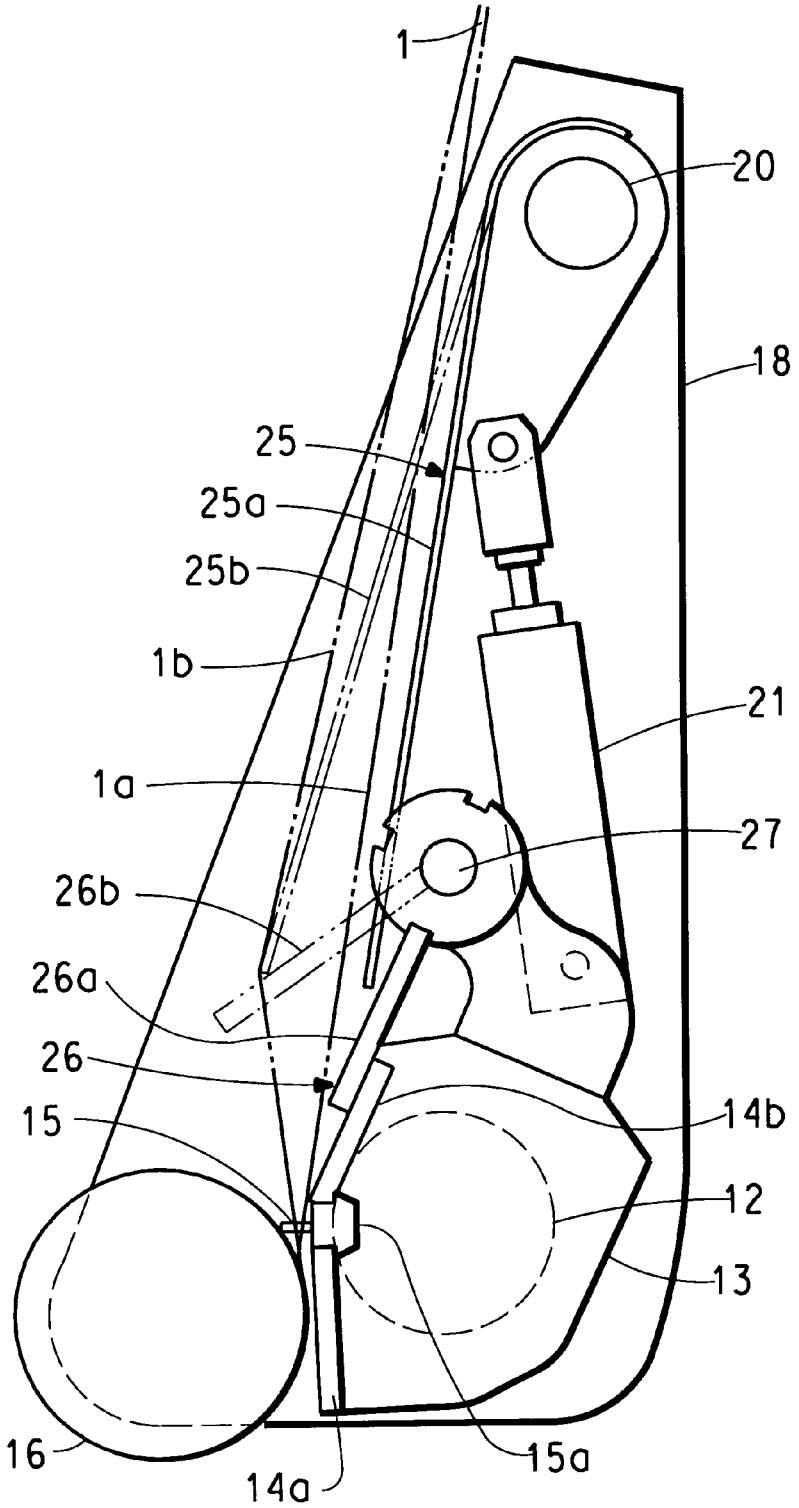
FIG. 2 illustrates in greater detail swing arm 18 and elements of the invention mounted thereon.

FIG. 2 illustrates in greater detail pendulous swing arm 18 and elements of the apparatus of the invention mounted thereon. For clarity, the swing arm shown is the one used at the rear (frame face) of the winder. Threadline 1 is shown in two positions 1*a* and 1*b*. Pneumatic cylinder 21 operates smooth-edged transfer flapper plate 25, shown in two positions 25*a* and 25*b*, which rotates around pivot point 20. Most spandex is wound without a transfer tail, and under these circumstances a smooth (not notched) transfer plate edge is needed. Shaft 27 is provided with a transfer tail cam which when translated along its axis, rotates transfer tail arm 26 from position 26*a* in the plane of the drawing to position 26*b* which is also out of the plane of the drawing toward the viewer. A transfer tail arm is provided for each package in order to allow creation of a transfer tail on those occasions when a tail is desired. Having separate mechanisms for "no-tail" (smooth transfer plate but no transfer tail arm in use) and "tail" (transfer tail arm) winding provides increased winding options and more certain control over the threadline. Traverse guide 15 is shown mounted in cam follower 15*a*, which slides between rails 14*a* and 14*b* and rides in grooves (not shown) in traverse cam 12. The traverse cam is rotatably mounted in cam box 13, which is fixedly mounted on swing arm 18.

Figure 3:
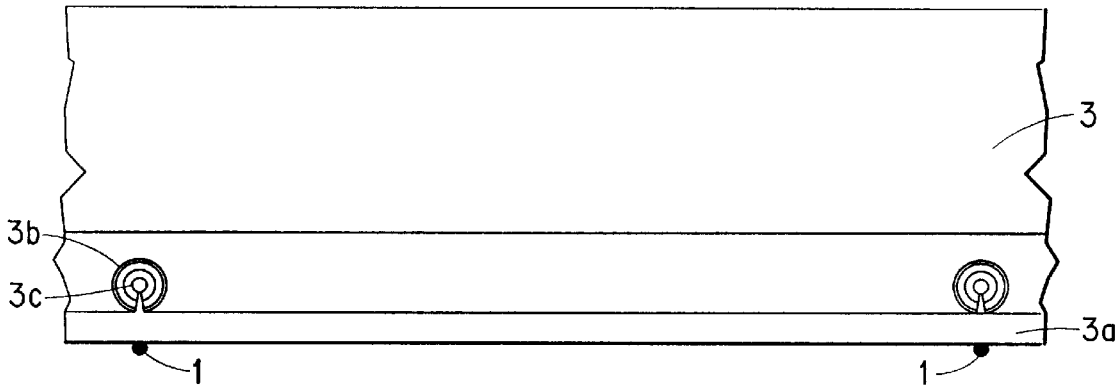
FIG. 3 illustrates a portion of a self-stringing fanning guide is illustrated from above.

Turning now to FIG. 3, a portion of self-stringing fanning guide 3 is illustrated from above. Knockout bar 3*a* can be selectively moved between retracted and forward positions to allow the elastomeric fiber to enter guide 3*b* or to force the fiber out of the guide. The bar is shown in the forward position, and threadlines 1, shown in cross-section, cannot enter guides 3*b*. Ceramic insert 3*c* is shown mounted inside guide 3*b*.

Figure 4:
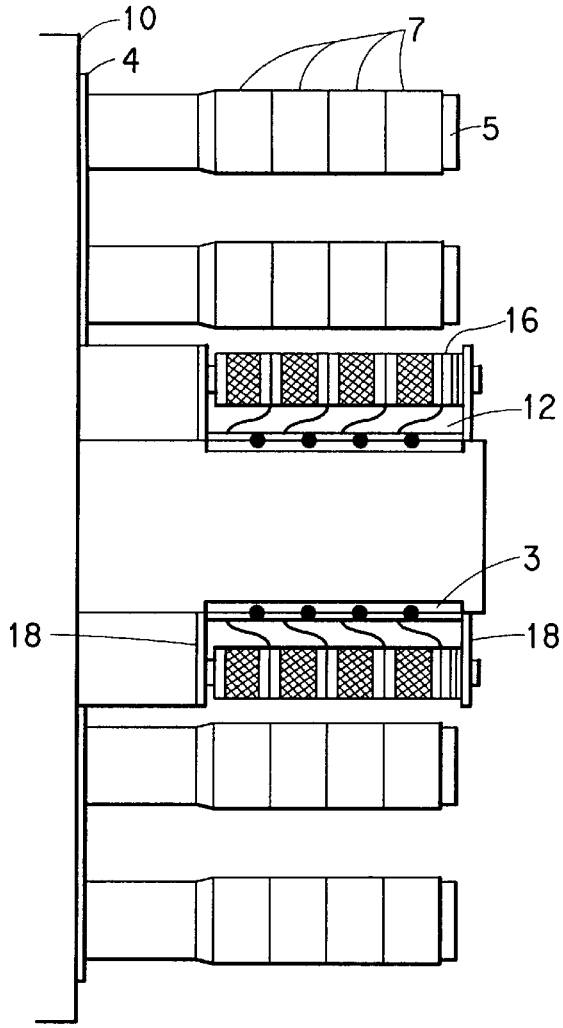
FIG. 4 shows two adjacent winders from the top.

FIG. 4 shows two winders from the top; two turrets 4 and their associated spindle assemblies 5 are illustrated. Each spindle assembly is shown with four tubecores 7 mounted thereon and is shown in association with one contact roll 16 and one cam 12, each cam having four sets of traversing grooves. Swing arms 18 are shown supporting contact rolls 16 and cams 12; the cam boxes, in which cams 12 are mounted, are not shown. The contact rolls are shown having alternating matte and mirror finish bands. Fanning guide 3 is also shown. The winder is shown in standby mode, with rolls 16 not in contact with tubecores 7.

The operation of the apparatus of the invention is described below, initially with reference to FIG. 1.

With the driven parts of the winder receiving power and in operation, stringup can be accomplished by an operator, for example by using a sucker gun, guiding fiber 1 through fanning guides 2 and optionally guides 3, through traverse guide 15, around contact roll 16, into the nip between the contact roll and tubecore 7 and around the tubecore. It can be helpful during stringup to run empty tubecore 7 at higher rotations per minute than would generally be used during winding. This applies greater tension to the elastomeric filament; the more tautly stretched filament is easier for the operator to guide to its proper position. After the filament has been successfully wrapped onto the tubecore, the speed can be reduced to operational speed for winding.

During stringup of lower winders A and B, the tension on the threadline created by initial winding is sufficient to move each threadline along knockout bar 3*a* and position such threadline in front of its appropriate guide 3*b* and then, when the bar is retracted, to move each threadline into its appropriate guide 3*b* in fanning guide 3 (see FIG. 3). To assist stringup, cylinder 21 (see FIG. 2) can be activated to move flapper plate 25 from position 25*a* to position 25*b*, thereby deflecting fiber 1 and moving it out of traverse guide 15. Moving the flapper plate back to position 25*a* allows the threadline to return to the traverse guide, so that traverse winding can begin.

Referring to winder C in FIG. 1, during winding, elastomeric fiber 1 is guided by fanning guide 2 to traverse guide 15, then clockwise around contact roll 16, and counterclockwise onto package 11. At the beginning of winding, if a transfer tail is desired (see FIG. 2), flapper plate 25 is moved from position 25*a* to position 25*b* by pneumatic cylinder 21, and transfer tail arm 26 is moved from position 26*a* to position 26*b* (out of the plane), thereby moving the threadline out of traverse guide 15 and to a position near the end of the tubecore (not shown), where winding is continued without traverse for a preselected time. When the desired transfer tail has been thus formed, the transfer tail arm returns to position 26*a*, the flapper plate is returned to position 25*a*, threadline 1 returns to traverse guide 15, and traverse winding onto the tubecore commences.

In FIG. 1, winders A and B illustrate a first spindle assembly 5*a* at the first winding position and a second spindle assembly 5*b* at the don/doff position. Winders C and D illustrate the first spindle assembly 5*a* at a second winding position.

At winder A of FIG. 1, an empty tubecore 7 is shown onto which fiber 1 is beginning to be wound.

Winder B shows a partially wound package 11, with swing arm 18 close to support 19 due to the force of growing package 11 on contact roll 16. Pneumatic pancake cylinder 24 provides resistance to the rotation of swing arm 18 about pivot point 20. A pancake cylinder is provided for each swing arm, in other words one cylinder at the front of support 19 and one near the face of frame 10. The pressure in the pancake cylinders is held at one or more predetermined levels by an electropneumatic regulator (not shown) and a programmable controller system (not shown). In turn, the pressure in the pancake cylinders determines the force of contact roll 16 against package 11. Such force can be kept substantially constant during winding or can be changed during winding to create a force profile. Except for the position of swing arm 18 and therefore the components mounted thereon, the positions of the components in winder B are the same as those in winder A but in mirror image.

The winder of the present invention can be used for a variety of winding methods. Such methods include stepped precision winding, in which the winding ratio, which is the ratio of the rotational speed, rpm, of the spindle assembly to the rpm of the traverse cam is kept substantially constant but preferably non-integral and is stepped to preselected values as the package grows; and random winding, in which the winding ratio is varied from the beginning to the end of the package. Various other types of ribbon breaking actions can also be applied to minimize the formation of ribbons.

A sensor, for example a magnetic pulse sensor (not shown), can monitor the rpm of contact roll 16, which rpm can be maintained substantially constant by adjustment of the rpm of spindle assembly 5. As the package diameter increases, the rpm of spindle assembly 5 can therefore be reduced in order to maintain proper winding speed.

For packages larger than a selected diameter, winding can take place at two indexed positions, the second position being able to accommodate a larger final diameter than the first position. Rotation of the turret to the second winding position can take place at any suitable point during winding, for example at a predetermined package diameter, spindle assembly rpm, or winding time. A specific example would be when the package diameter exceeds about 170 mm. The package diameter can be determined by the ratio of the contact roll surface speed to the spindle rpm. The rotation of the turret can be accomplished rapidly in about 1–60 seconds, compared to several hours of total winding per package. Such rapid movement of the turret between a limited number of indexed winding positions simplifies the turret rotation mechanism and the winding control system. Of course, winding continues during turret rotation, but such rotation is so rapid that at least about 99%, and preferably at least about 99.5%, of the winding occurs at the indexed positions. Thus, partially wound package 11 is moved from a point as shown in winder B to a point as shown in apparatus C of FIG. 1, where winding can continue. During the rotation of the turret from an earlier indexed position to a subsequent indexed position, contact roll 16 is swung outward to maintain contact with the surface of the package being wound.

As shown in greater detail in FIG. 5 for two-position winding, a partially wound package is rotated from the first indexed winding position at 28*a* to the second indexed winding position at 28*b*. The package at 28*a* is at the end of first position winding, and the package at 28*b* is at the beginning of second position winding. The angle theta (the "swept angle") through which an imaginary line, drawn between the axis SA of the spindle assembly (which coincides with the axis of a tubecore mounted on the spindle assembly) and the axis CR of the contact roll, sweeps during rotation of the turret from one indexed winding position to the next indexed winding position is at least about 10°, is preferably at least about 35°, and is more preferably about 40°–50°. In FIG. 5, the imaginary line is indicated at two positions, $L_1$, and $L_2$ corresponding to two indexed winding positions.

Winder D of FIG. 1 illustrates a full package 23 ready for transfer (that is, changing the winding filament from a full package to an empty tubecore). This point can be determined by the total time the package has been winding, by spindle rpm, or by package diameter. The relative locations of the tubecores, package and other components are substantially the same as in winder C (except for swing arm 18 and components mounted thereon) but shown in mirror image to winder C.

If a transfer tail is also desired, on the next tube to be wound, in preparation for transfer, activation of cylinder 21 (see FIG. 2) moves transfer flapper plate 25 from position 25*a* to position 25*b*. The fiber is no longer moved in a traversing path by the traverse guide, so a short "belly band" is formed near the edge of the outer surface of the full package. Optionally, transfer tail arm 26 can be moved from position 26*a* to position 26*b* (out of the plane) so that the filament is being wound on the bare part of the tubecore instead of on the package itself.

Figure 6A:
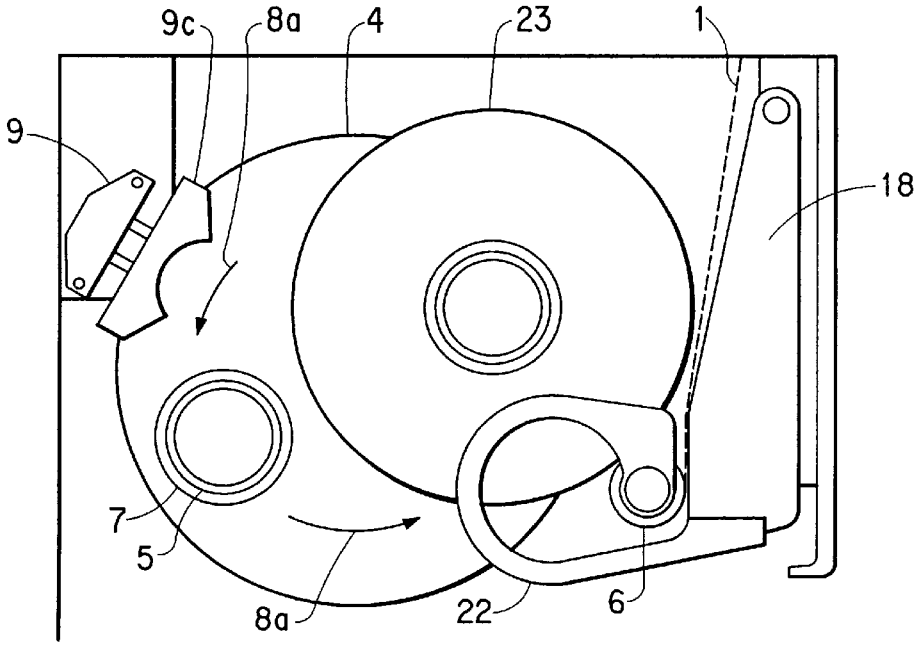
FIGS. 6A and 6B show turret over rotation that can optionally be used during elastomeric yarn transfer.
Figure 6B:
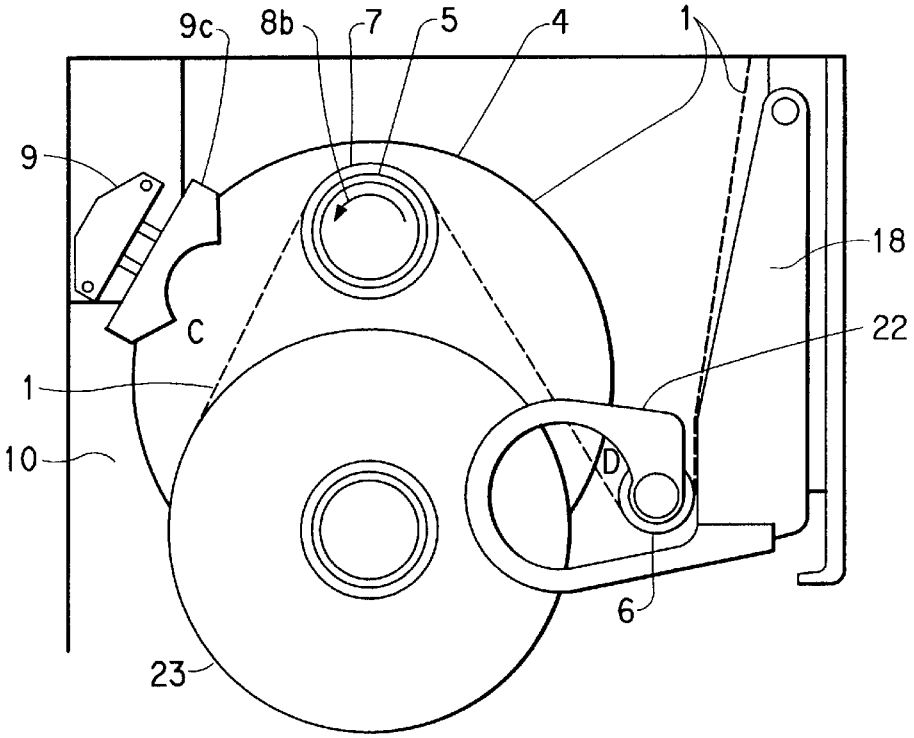

During transfer, especially for elastomeric yarns, turret 4 can rotate from the orientation shown for winder D in FIG. 1 to a position beyond that shown for winder A in FIG. 1. This is illustrated in FIGS. 6A and 6B, wherein the indicated winder parts are numbered as above. FIG. 6A shows the winder with full package 23 just before transfer. FIG. 6B shows the winder in the process of filament transfer. Turret 4 has rotated beyond the first winding position, and continuous filament 1 can now pass around contact roll 6, around empty tubecore 7 (rotating in the direction shown the arrow 8*b*), and then onto full package 23. Thus, the turret can temporarily rotate to a position beyond the first indexed winding position, for example, by up to about 90°–120°, in order to decrease the wrap angle on the contact roll and increase the wrap angle on the empty tubecore, thereby increasing the security and efficiency of the transfer. During this over rotation, the incoming or upstream filament is not held in contact with the outgoing or downstream filament, nor is a mechanical arm needed to push the incoming filament around the empty tubecore. These simplifications reduce the potential for tangled yarn and the mechanical complexity of the winder. The rotational speeds of spindle assemblies 5 can be accelerated or decelerated as desired during transfer to maintain proper yarn tension, to bring an empty tubecore up to speed, and the like. For example, during yarn transfer and turret rotation from a position as shown in FIG. 6A to a position as shown in FIG. 6B, the rotational speed of full package 23 can be reduced, allowing a yarn loop to form which can create a wrap on empty bobbin 7. As fiber begins to wind on tubecore 7, it is stretched to breaking between empty tubecore 7 and full package 23. When yarn transfer is complete, the turret rotates back again to the position shown for winder A in FIG. 1, and initial winding commences in the first winding position. This back-rotation during yarn transfer constitutes a brief exception to the substantially co-rotating operation of the turret and spindle assemblies when the winder is used for elastomeric filament winding.

If a fiber wrap occurs on contact roll 16, wrap removal guide bar 17 prevents the wrap removal tool from accidentally being carried by friction with the contact roll into a position where the tool or the wrap can interfere with traverse guide 15, cam 12, and other nearby components. During transfer, low pressure air can be briefly blown through the central void of wrap removal guide bar 17 and out through the holes of the guide bar's wall toward each full package 23 (at point D in FIG. 6B) to prevent yarn loops and/or broken filaments from becoming entangled with contact roll 16. During transfer, air can also be blown onto the threadline between the empty tubecore and the full package (at point C in FIG. 6B) so that when the threadline is broken, the broken filaments are blown onto their proper packages and do not become entangled with the wrong package.

As shown in FIG. 1, the cross-section of transfer shield 6 is in the form of oppositely oriented joined apexes having a unitary construction and fixed configuration. The diamond-shaped enclosure in the center provides rigidity to the shield. The shield is slidably mounted between spindle assemblies 5*a* and 5*b* so that each apex can approach its corresponding spindle assembly. The transfer shield serves two functions: i) immediately after transfer, when full package 23 is still rotating and its outside filament is still flying free after being broken, the shield keeps the free end from being caught on empty tubecore 7; and ii) when the fiber is displaced by arm 26 in preparation for transfer and winding a transfer tail on the new tubecore, notches (not shown) in the end of the shield prevent fiber that is being wound from being pulled off the outer surface of full package 23; the notches are about ½ the width of the wound package. The transfer shield automatically begins to affect the traversing fiber as turret 4 rotates in preparation for transfer.

At the doff/don position, as shown for full package 23 on winder A in FIG. 1, push-off assembly 9 is moved forward by pneumatic cylinder 9*a* (seen in cross-section at winder C). Push-off paddle 9*c* is thereby urged against package 23 and pushes the package off spindle assembly 5. If desired, a plurality of packages can be pushed off the spindle assembly at one time.

Referring again to winder A in FIG. 1, after full package 23 is doffed from spindle 5, transfer shield 6 is slidably moved from location 6*a* to location 6*b* as shown by the straight arrow, in order to accommodate the increasing diameter of the new package being wound on tubecore 7.

When non-elastomeric filaments are being wound, the winder has many of the same features and is operated in a similar manner as when elastomeric fibers are being wound. Therefore, only the differences will be described here. The differences include the support being attached to the side of the frame instead of the front face, a lower minimum degree of pivoting of the swing arm (at least about 5°), use of grooved tubecores, counter-rotation of the turret compared to the spindle assemblies, absence of over-rotation during yarn transfer, a different transfer arm design and mounting location, and a different range of wrap angles around the contact roll, about 165°–220°.

FIGS. 8A–D (for non-elastomeric fibers) are similar to portions A–D of FIG. 1 (for elastomeric fibers) but are less detailed and represent only one orientation of the winder rather than the back-to-back mirror images depicted in FIG. 1.

Figure 8A:
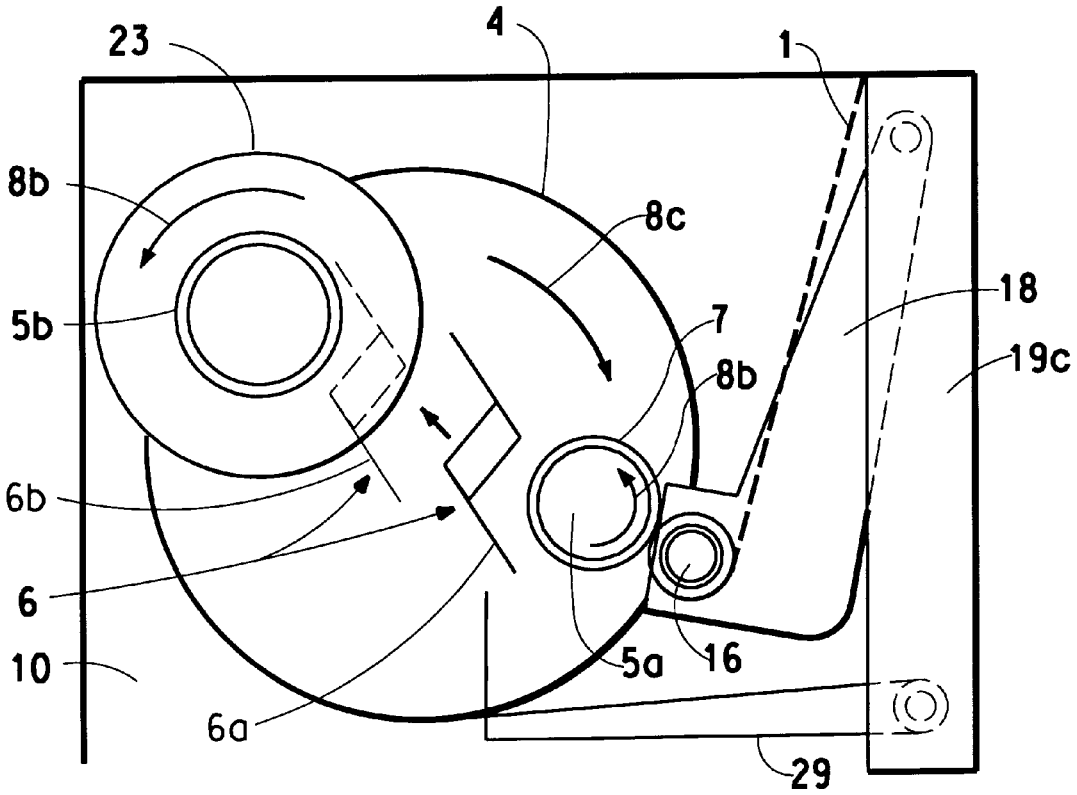
FIGS. 8A–D illustrate a winding sequence similar to portions A–D of FIG. 1, but for non-elastomeric fibers.

FIG. 8A is similar to portion A of FIG. 1 but in mirror image. Empty grooved tubecore 7 is mounted on spindle assembly 5*a*, and non-elastomeric fiber 1 is beginning to be wound onto the empty tubecore. Full package 23 is ready for doffing, after which slidable transfer shield 6 will be moved away from spindle assembly 5*a* and toward spindle assembly 5*b*. During winding, the turret rotates rapidly between indexed positions in the direction of arrow 8*c* (clockwise in this orientation), and the spindle assemblies rotate in the direction of arrow 8*b* (counterclockwise in this orientation). Thus, when winding non-elastomeric filaments on the winder of the invention, the spindle assemblies rotate in the opposite direction ("counter-rotate") from the turrets on which they are mounted. Each tubecore has a circumferential groove (not shown) cut into it for catching and holding a non-elastomeric fiber during yarn transfer so that the fiber will break and begin winding onto the empty tubecore.

Figure 8B:
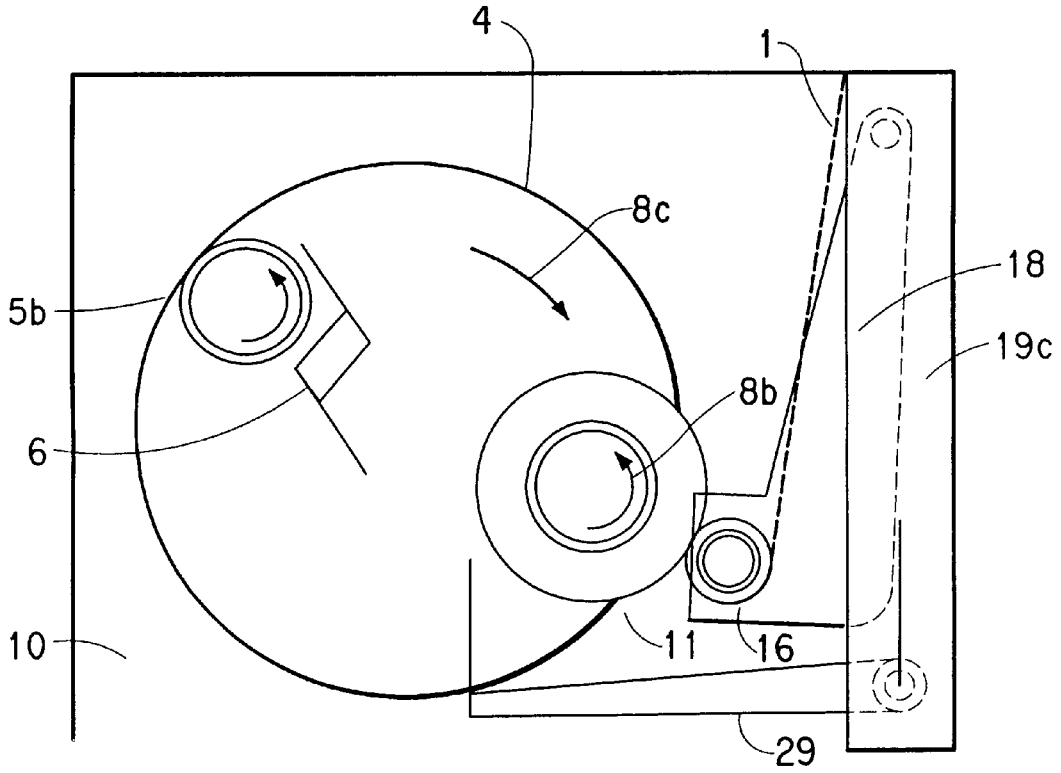
Figure 8C:
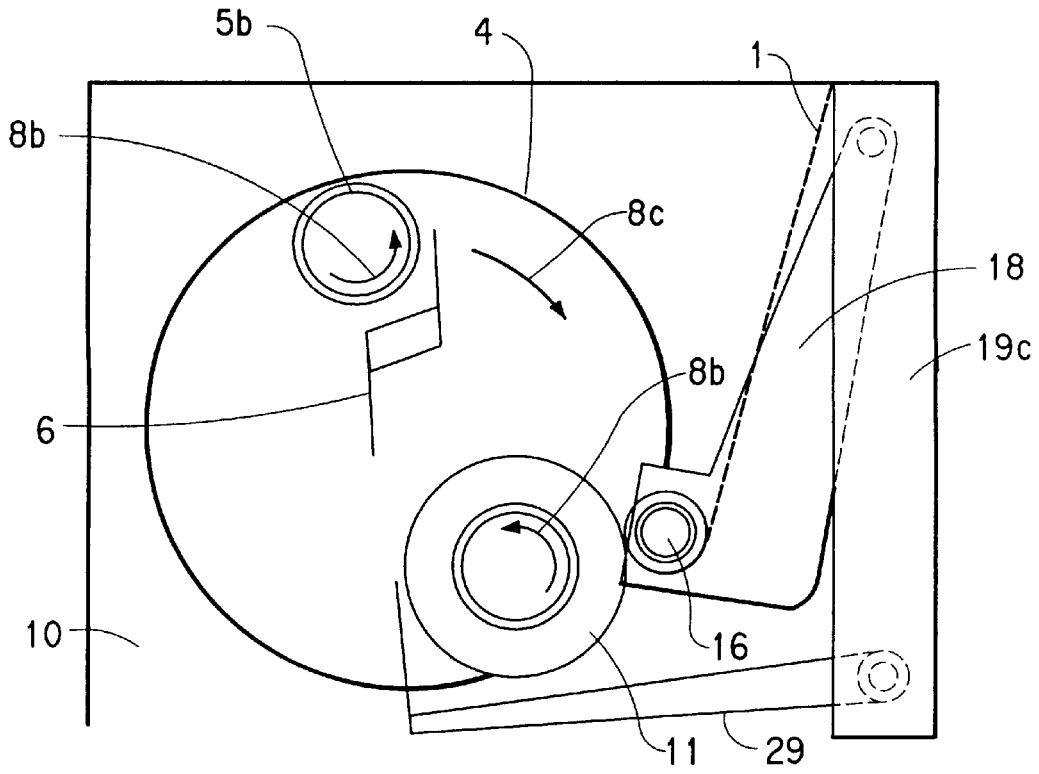
Figure 8D:
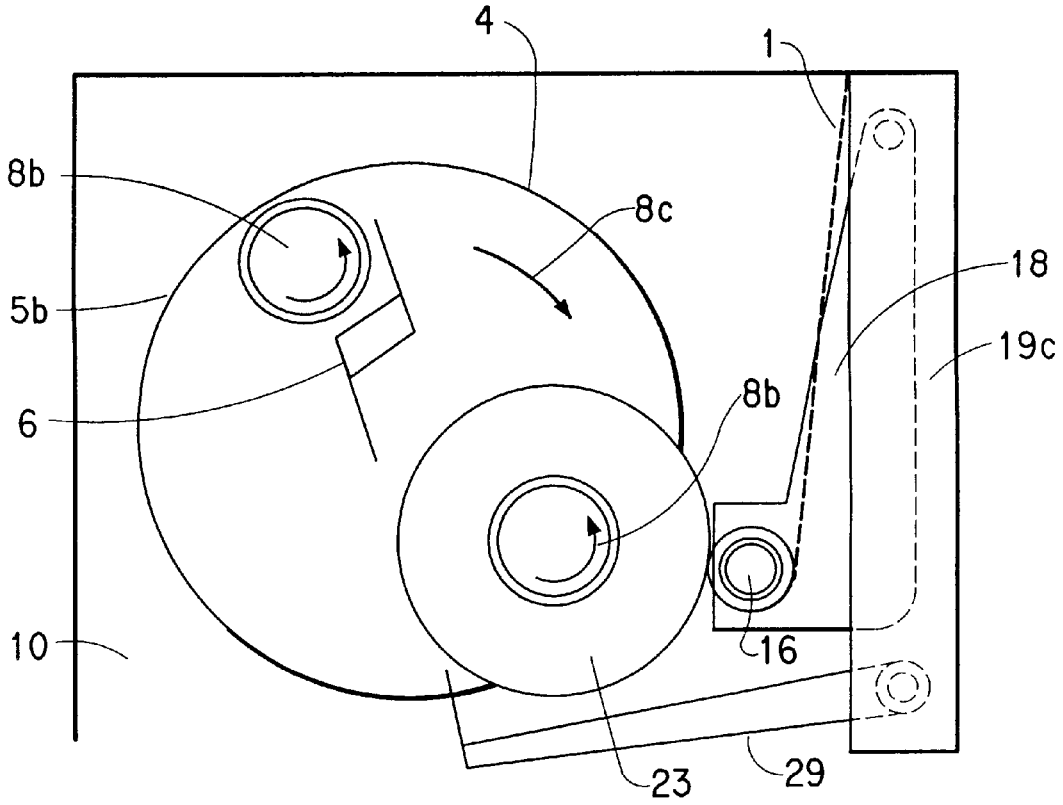

FIG. 8B is similar to portion B of FIG. 1 and shows partially wound package 11 pressing against contact roll 16 and therefore moving arm 18 into a more nearly vertical position. Full package 23 is not shown because it has been doffed. Slidable transfer shield 6 has been moved close to spindle assembly 5*b*. FIG. 8C is similar to portion C of FIG. 1 and shows turret 4 rotated to a second indexed winding position in the direction of arrow 8*c*. Swing arm 18 has moved to a less vertical position as a result. FIG. 8D is similar to portion D of FIG. 1 (but in mirror image) and shows fully wound package 23 ready for yarn transfer to empty tubecore 7 mounted on spindle assembly 5*b*. Due to the direction of rotation of the turret between indexed positions, the range of wrap angles around contact roll 16 is lower for non-elastomeric fibers than for elastomeric fibers, being about 165°–220°. Swing arm 18 has once again moved back to a more vertical position.

Figure 7:
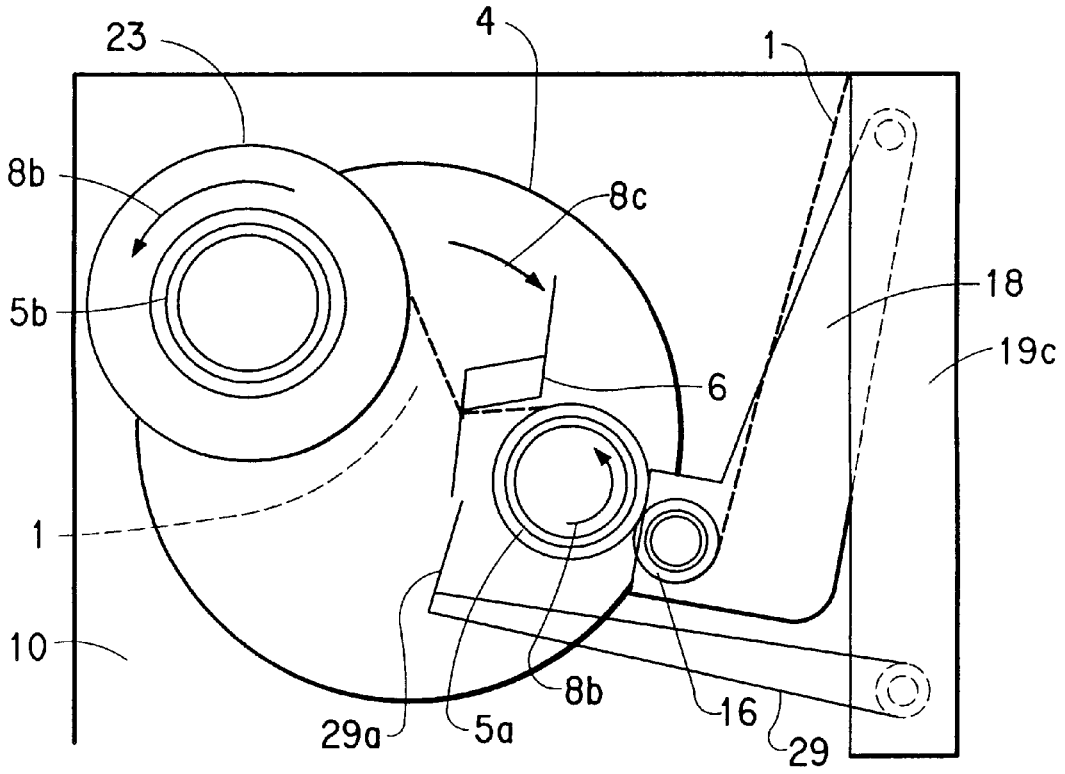
FIG. 7 illustrates yarn transfer of non-elastomeric fibers using the winder of the invention.

As illustrated in FIG. 7, during yarn transfer, empty tubecore 7 has been moved into contact with non-elastomeric fiber 1 by rotation of turret 4 in the direction of arrow 8*c* to the first indexed winding position and spindle assembly 5 is rotating in a direction 8*b* opposite to the direction of arrow 8*c* as well as opposite to the movement of filament 1. The filament will be broken between full package 23 and empty tubecore 7, having been caught by a semi-circumferential groove (not shown) in the tubecore, and the fiber will then begin winding on the new tubecore. "Over" rotation during yarn transfer is not necessary when non-elastomeric filaments are being wound.

Figure 9:
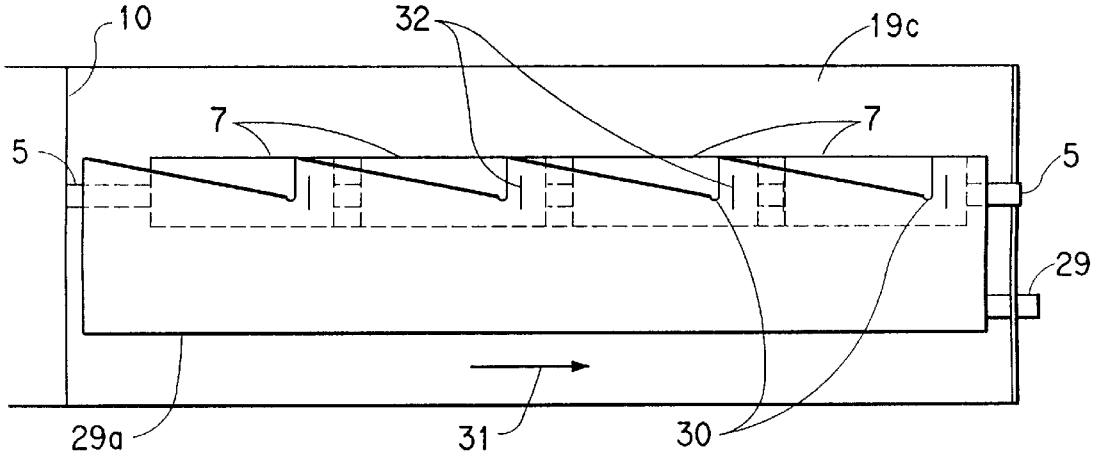
FIG. 9 shows a transfer tail plate used in winding non-elastomeric yarns.

Another difference between the winder for elastomeric and non-elastomeric fibers is the mounting location and design of the transfer tail arm. In FIGS. 7 and 8, arm 29 is mounted on support 19*c*, which in turn is mounted on the side face (not shown) of the winder. During yarn transfer (FIG. 7), it pivots up so that transfer tail plate 29*a* enters the path of filament 1 between spindle assembly 5*a* and transfer shield 6. Another view of transfer tail plate 29*a* is shown in FIG. 9, wherein transfer tail arm 29 is mounted on support 19*c*. It can be seen that the plate has a saw-tooth edge and a small notch 30 at the bottom of each saw-tooth. Plate 29*a* is shown in relationship to empty tubecores 7 into which semi-circumferential grooves or slots 32 have been cut. Tubecores 7 are shown mounted on spindle assembly 5.

In operation, after plate 29*a* has captured the filaments and each fiber has slid down a saw tooth into a notch 30, the plate can temporarily be moved along its axis in the direction shown by arrow 31 so that the filaments are stroked across groove 32 in rotating tubecore 7, where they are caught; this stroking action increases the certainty and precision of transfer. Continued rotation of spindle assembly 5 stretches the filaments between tubecores 7 and the fully wound package (not shown) until the fibers break.

We claim:

1. A winder for winding synthetic continuous elastomeric filaments, comprising:

(a) a frame having a front face;

(b) a support mounted on the face and perpendicular to the face;

(c) a driven turret having an axis and being rotatably mounted on the face;

(d) a first driven spindle assembly having an axis and a second driven spindle assembly, the spindle assemblies being rotatably mounted on the turret on opposite sides of the turret axis and being capable of having tubecores mounted thereon;

(e) a freely rotatable contact roll having an axis and being mounted substantially parallel to the first and second spindle assemblies and below a horizontal plane in which the turret axis lies; and (f) a traverse assembly comprising a traverse cam mounted axially parallel and adjacent to the contact roll so that filament passing the traverse assembly is capable of traversing back and forth along the contact roll, the traverse assembly and contact roll being mounted on a pendulous swing arm pivotably mounted on the support and capable of pivoting through at least 7°;

wherein the turret, first and second spindle assemblies, swing arm, traverse assembly, and contact roll are mounted in order that (i) rotation of the turret to a first indexed winding position is capable of urging a tubecore mounted on the first spindle assembly against the contact roll for partial winding of a package;

(ii) during rapid rotation of the turret to and between 1–4 subsequent indexed winding positions, the partially wound package on the first spindle assembly can remain in contact with the contact roll;

(iii) rotation of the turret to a final position is capable of presenting the package on the first spindle assembly for doffing and is capable of urging a tubecore on the second spindle assembly against the contact roll for first position winding;

(iv) a filament wrap angle around the contact roll of about 180°–225°; and (v) at least about 99% of the winding occurs at the indexed positions.

2. The winder of claim 1 having two subsequent indexed winding positions wherein:

(a) the swing arm is capable of pivoting through at least about 10°;

(b) during each rotation of the turret from the first indexed winding position to a first subsequent winding position and a second subsequent winding position, the swept angle is at least about 35°; and (c) the current and spindle assemblies co-rotate during winding.

3. The winder of claim 2 having one subsequent indexed winding position wherein during rotation of the turret from the first indexed winding position to the first subsequent winding position the swept angle is 40°–50°.

4. The winder of claim 2 further comprising a package pushoff assembly mounted on the frame and a unitary, fixed configuration, notched transfer shield in the form of oppositely oriented joined apexes, the transfer shield being slidably mounted on the turret.

5. The winder of claim 2 further comprising a transfer flapper plate, transfer tail cam, and transfer tail arm mounted on the swing arm wherein an end of the contact roll is supported by a bearing support rail.

6. A group of two winders of claim 2 arranged in a vertical relationship wherein a self-stringing guide is mounted on the support and a hinged knockout bar is mounted adjacent to the guide so that when moved forward, the bar prevents filaments from entering the guide.

7. A method for winding synthetic continuous elastomeric filament comprising the steps of:

(a) passing the filament through a cam-driven traverse guide and around a contact roll having an axis with a wrap angle of about 180°–225°;

(b) winding the filament onto a first indexed tubecore at a first winding position to form a partially wound package;

(c) rapidly moving the partially wound package to and between 1–4 subsequent indexed winding positions;

(d) winding the filament onto the partially wound package at each subsequent indexed winding position to form a fully wound package, at least about 99% of the winding occurring at the indexed positions;

(e) rapidly moving the fully wound package to a final position for doffing and simultaneously moving a second tubecore to the first winding position;

(f) transferring the filament from the fully wound package to the second tubecore; and (g) winding the filament onto the second tubecore.

8. The method of claim 7 wherein:

(a) in step (c), the partially wound package is rapidly moved to and between two subsequent indexed winding positions;

(b) during each subsequent movement the swept angle is at least about 35°; and (c) such movement is in the same direction as the tubecore winding direction.

9. The method of claim 8 wherein in step (c), the partially wound package is rapidly moved to one subsequent indexed winding position and wherein during such movement the swept angle is about 40°–50°.

10. The method of claim 9 wherein said method comprises an additional step of moving the second tubecore temporarily to a position beyond the first winding position while transferring the filament from the fully wound package to the second tubecore.

11. The method of claim 10 further comprising the following steps:

(a) removing the fully wound package from the winder;

(b) mounting a second, empty tubecore at the final position on the winder; and (c) sliding a unitary, fixed configuration, notched transfer shield in the form of oppositely oriented joined apexes from a position adjacent to the second tubecore to a position adjacent to the empty tubecore.

12. A winder for winding synthetic continuous non-elastomeric filaments, comprising:

(a) a frame having a front face and a side face;

(b) a support mounted on the side face and perpendicular to the front face;

(c) a driven turret having an axis and being rotatably mounted on the face;

(d) a first driven spindle assembly having an axis and a second driven spindle assembly, the spindle assemblies being rotatably mounted on the turret on opposite sides of the turret axis and being capable of having grooved tubecores mounted thereon;

(e) a freely rotatable, cantilevered contact roll having an axis and being mounted substantially parallel to the first and second spindle assemblies and below a horizontal plane in which the turret axis lies; and (f) a traverse assembly comprising a traverse cam mounted axially parallel and adjacent to the contact roll so that filament passing the traverse assembly is capable of traversing back and forth along the contact roll, the traverse assembly and contact roll being mounted on a pendulous swing arm pivotably mounted on the support and capable of pivoting through at least about 5°;

wherein the turret, first and second spindle assemblies, swing arm, traverse assembly, and contact roll are mounted so that:

(i) rotation of the turret to a first indexed winding position is capable of urging a grooved tubecore mounted on the first spindle assembly against the contact roll for partial winding of a package;

(ii) during rapid rotation of the turret to and between in the range of one to four subsequent indexed winding positions, the partially wound package on the first spindle assembly can remain in contact with the contact roll;

(iii) rotation of the turret to a final position is capable of presenting the package on the first spindle assembly for doffing and is capable of urging a grooved tubecore on the second spindle assembly against the contact roll for first position winding;

(iv) a filament wrap angle around the contact roll is about 165°–220°;

(v) at least about 99% of the winding occurs at the indexed positions; and (vi) the turret and spindle assemblies counter-rotate.

13. The winder of claim 12 having two subsequent indexed winding positions wherein during rotation of the turret from the first winding position to a first subsequent winding position and between the first subsequent winding position and a second subsequent winding position, the swept angle is at least about 35°.

14. The winder of claim 13 further comprising a package pushoff assembly mounted on the frame and a unitary, fixed configuration, notched transfer shield in the form of oppositely oriented joined apexes, the transfer shield being slidably mounted on the turret.

15. The winder of claim 13 further comprising a smooth-edged transfer flapper plate mounted on the swing arm and a transfer tail arm mounted on the support.

16. A method for winding synthetic continuous non-elastomeric filament comprising the steps of:

(a) passing the filament through a cam-driven traverse guide and around a contact roll with a wrap angle of about 165°–220°;

(b) winding the filament onto a first grooved tubecore at a first indexed winding position to form a partially wound package;

(c) rapidly moving the partially wound package to and between in the range of one to four subsequent indexed winding positions, the direction of movement being opposite to the direction of tubecore winding;

(d) winding the filament onto the partially wound package at each subsequent indexed winding position to form a fully wound package, at least about 99% of the winding occurring at the indexed positions;

(e) rapidly moving the fully wound package to a final position for doffing and simultaneously moving a second grooved tubecore to the first winding position;

(f) transferring the filament from the fully wound package to the second tubecore; and (g) winding the filament onto the second tubecore.

17. The method of claim 16 wherein in step (c), the partially wound package is rapidly moved to and between two subsequent indexed winding positions, and wherein during each such movement the swept angle is at least about 35°.

18. The method of claim 17 further comprising the following steps:

(h) removing the fully wound package from the winder;

(i) mounting a second, empty grooved tubecore at the final position on the winder; and (j) sliding a unitary Z-shaped, fixed configuration, grooved transfer shield from a position adjacent to the second tubecore to a position adjacent to the empty tubecore.

* * * * *